United States Patent [19]

Wollnik et al.

[11] Patent Number: 4,924,090

[45] Date of Patent: May 8, 1990

[54] DOUBLE FOCUSING MASS SPECTROMETER AND MS/MS ARRANGEMENT

[76] Inventors: Hermann Wollnik, auf der Platte 30, 6301 Fernwald 2, Fed. Rep. of Germany; Hisashi Matsuda, 2-27-19 Kiyoshikojin, Takarazuka 665, Japan

[21] Appl. No.: 301,514

[22] Filed: Jan. 24, 1989

[30] Foreign Application Priority Data

Jan. 26, 1988 [DE] Fed. Rep. of Germany ..... 3802171
Apr. 22, 1988 [DE] Fed. Rep. of Germany ..... 3813641

[51] Int. Cl.[5] ..... H01J 49/32

[52] U.S. Cl. ..... 250/296; 250/396 ML; 250/299

[58] Field of Search ..... 250/281, 283, 296, 297, 250/299, 396 ML

[56] References Cited

U.S. PATENT DOCUMENTS

| | | | |
|---|---|---|---|
| 4,019,989 | 4/1977 | Hazewindas et al. | 250/396 ML |
| 4,022,876 | 10/1977 | Anbar | 250/28 L |
| 4,054,796 | 10/1977 | Naito | 250/296 |
| 4,066,895 | 1/1978 | Iwanaga | 250/296 |
| 4,521,687 | 6/1985 | Naito | 250/283 |
| 4,645,928 | 2/1987 | Naito | 250/296 |

FOREIGN PATENT DOCUMENTS

| | | | |
|---|---|---|---|
| 1698248 | 1/1973 | Fed. Rep. of Germany | 250/296 |

OTHER PUBLICATIONS

"In Optics Multipoles", Boerboom, *Nucl. Ins. and Methods in Physics Research,* pp. 426–430, 1987.

"Compact Double Focusing Mass Spectrometer Design for Partical Pressure Measurements", D. Ioanoviciu et al., *Vacuum,* vol. 24, No. 6, pp. 245–247, 1974.

"Development of a Fast Ion Mass Spectrometer for Space Research", Hahn et al., *Rev. Sci. Inst.,* vol. 52, No. 2, pp. 247–255, Feb. 1981.

*Primary Examiner*—Bruce C. Anderson

*Attorney, Agent, or Firm*—Flehr, Hohbach, Test, Albritton & Herbert

[57] ABSTRACT

The invention relates to a double focusing mass spectrometer with a combination of an electric and of a magnetic field for directional and velocity focusing. In order to provide a compact and constructionally simple arrangement, it is proposed that a common magnet is used for the Wien filter (10) and the sector magnet (11). Preferably, this double focusing mass spectrometer is used in an MS/MS arrangement.

14 Claims, 3 Drawing Sheets

DOUBLE FOCUSING MASS SPECTROMETER AND MS/MS ARRANGEMENT

Figure 1:
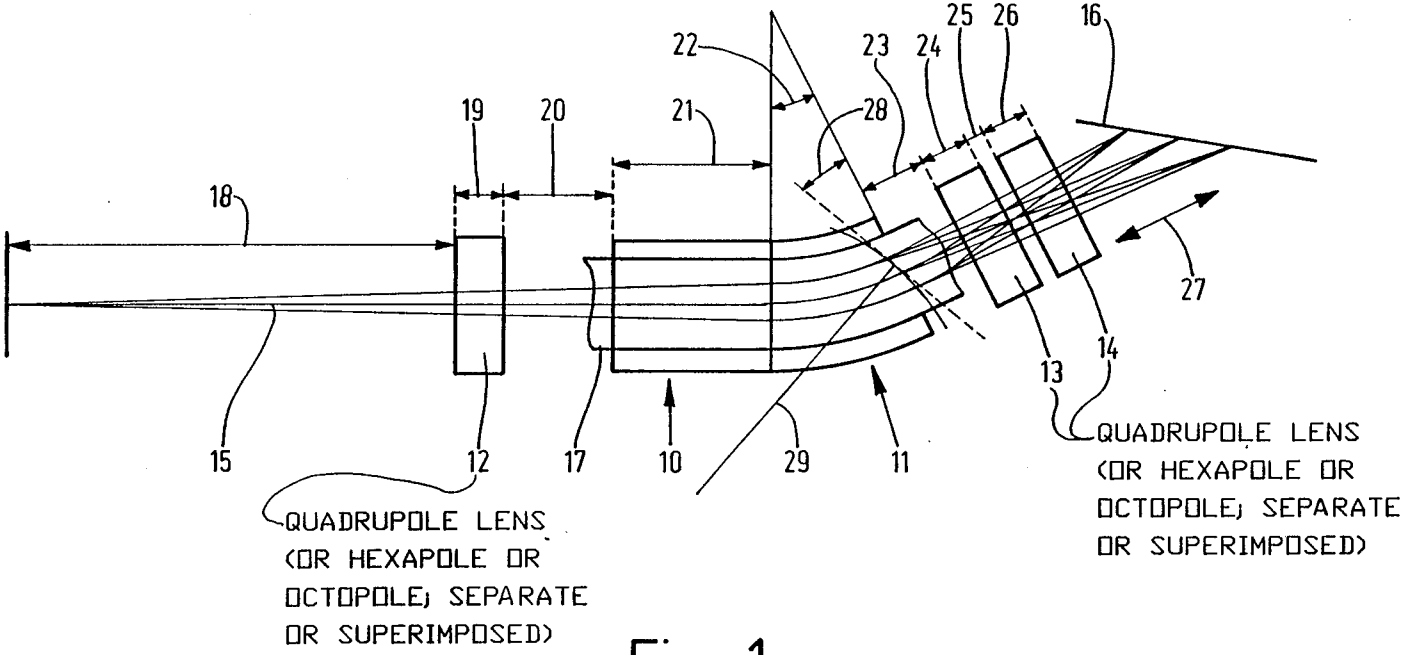

The invention relates to a double focusing mass spectrometer and furthermore to an MS/MS arrangement.

Such mass spectrometers are known in principle, and can be used, for example, advantageously for the mass analysis of ions of approximately equal velocity, as they are formed, for example, in the dissociation of large molecules.

Furthermore, the prior art discloses MS/MS arrangements which consist of three main components: a first mass spectrometer (Ist analyzer), which generates a beam of so-called "parent ions"; a so-called CID device, which consists of a collision cell, in which the "parent ions", are split up into fragments, so-called "daughter ions", and a second mass spectrometer (IInd analyzer), which distinguishes the "daughter ions" with respect to their mass and/or energy.

If double focusing mass spectrometers are used in each instance with the application of an electrostatic field, then the ions are, disadvantageously, split up to a very great extent, which means, in the case of an MS/MS arrangement, that in all cases an analysis by the IInd analyzer can take place only for one of the ion masses leaving the Ist analyzer. If the intention is to establish an entire spectrum, an appropriate mass sweep must be carried out.

Accordingly, it is the object of the present invention to provide a double focusing mass spectrometer or an MS/MS arrangement, which can be constructed as simply and inexpensively as possible and with which the costly adjustment of the fields relative to one another which is possibly necessary where differing magnetic fields are used is avoided; in particular, the simultaneous analysis within a larger mass range is to be possible.

The object related to the mass spectrometer of the type concerned is achieved in that a Wien filter and a sector magnet which exhibit a common magnet are combined.

The advantage of the invention resides, in particular, in that in the Wien filter which is provided in place of the electrostatic sector field which is used and which is known according to the prior art, the magnetic and the electrostatic deviating force are compensated, i.e. the ions of approximately the same velocity are deflected equally strongly, and therefore remain close beside one another. The dispersion occurring as a result of the differing ion velocities is then compensated by the sector magnetic field; in this case, the mass dispersion continues to be obtained.

A so-called conventional Wien filter is understood to refer to a plate capacitor, which is situated, at least for the major part of its length, in a homogeneous magnetic field.

However, such Wien filters for the full compensation of the magnetic and electrostatic deviating forces are also possible, in which the magnetic field in the region of the Wien filter is generated between plane but mutually inclined pole pieces (a so-called wedge magnetic field) and the electrodes of a Wien filter are cylindrical. As compared with such a Wien filter the conventional Wien filter represents a special case, because there the wedge angle of the magnet pole pieces goes towards zero and the vertical radius of curvature of the cylindrical electrodes is infinite.

The use of a common magnet for the Wien filter and the sector magnet also gives the advantage that the mass spectrometer can be built, in particular, in a space-saving manner, but also more inexpensively. Moreover, there is the saving of the exact adjustment—the scanning—of the two separate magnetic fields in the Wien filter and in the sector magnet, since, according to the invention, the two are equally large.

In a particularly compact embodiment, the pole pieces of the common magnet are constructed to be continuous, in such a manner that the electrodes (capacitor plates) of the Wien filter project only slightly into the magnetic field, and the remaining part of the magnetic field then serves as sector magnet.

As an alternative to this, it is however also possible to provide in each instance separate pole piece pairs for the Wien filter and the sector magnet; however, both pole piece pairs then have a common magnet coil, and preferably also a common magnet yoke.

If it is desired to create a magnetic field which is homogeneous in each instance, then continuous, flat pole pieces which are parallel to one another are used; as an alternative to this, the pole pieces can also be inclined to one another in the sense of a wedge arrangement. Finally, however, conical, i.e. toroidal magnet pole piece arrangements are also possible for the sector magnetic field and/or for the Wien filter. In the case of continuous pole pieces in toroidal form, there is likewise the possibility of providing differing cone radii in the Wien filter region and in the region of the sector magnet respectively. In the case of separate magnet pole piece pairs in the Wien filter and sector magnet, it is possible in each instance to construct expedient combinations of parallel, wedge-shaped and/or toroidal pole piece arrangement. Furthermore, for the generation of the electric field in the region of the Wien filter there is a corresponding possibility of selection between mutually parallel electrode plates or cylindrical and/or toroidal electrodes which are disposed in each instance likewise so as to be parallel to one another.

In order to achieve a magnetic field which is influenced as little as possible by the stray flux, the magnet pole pieces must be as broad as possible in proportion to their spacing or average spacing. With a view to a simple magnet construction, the pole piece spacing is, however, chosen so as to be as small as possible; however, this greatly restricts the height o& the electrodes. In these circumstances, there is the problem that the electrostatic field does not, in most cases, have the adequate quality. A remedy is provided by a further development of the invention, in that wire-type intermediate electrodes are set to such potentials that the best possible cylindrical field or the best possible toroidal field is formed in the entire space between the electrodes. In place of the wire-type intermediate electrodes, it is also possible alternatively to arrange parallel sheet metal strips and/or parallel conductive paths, preferably on printed circuits, in an appropriate design, i.e. in a plate shape, in a cylinder shape or in a toroidal shape. Preferably, a separating tube which is rectangular in cross section extends through the entire Wien filter, to which separating tube the electrodes and/or intermediate electrodes are secured.

The optical properties of the Wien filter-sector magnet combination, i.e. the transmission as well as the position and form of the image curves of the double focusing mass spectrometer, are preferably improved in that a quadrupole optical system which consists in each instance of one or more electrostatic or magnetic quadrupole lenses is connected in each instance upstream and/or downstream of the combination. It is, however, also possible for hexapole or octopole arrangements, which consist in each instance of one or more electrostatic and/or magnetic hexapoles or octopoles to be connected upstream and/or downstream. Furthermore, these can preferably be superimposed on one or more quadrupoles. This measure serves, in particular, for the generation of a precise image plane, but also to shorten the overall mass spectrometer arrangement.

The object related to the MS/MS arrangement is achieved by the measures which are set forth in claims 16 and 17 and the advantages of which are evident—as already set forth hereinabove—in a corresponding manner.

Figure 2:
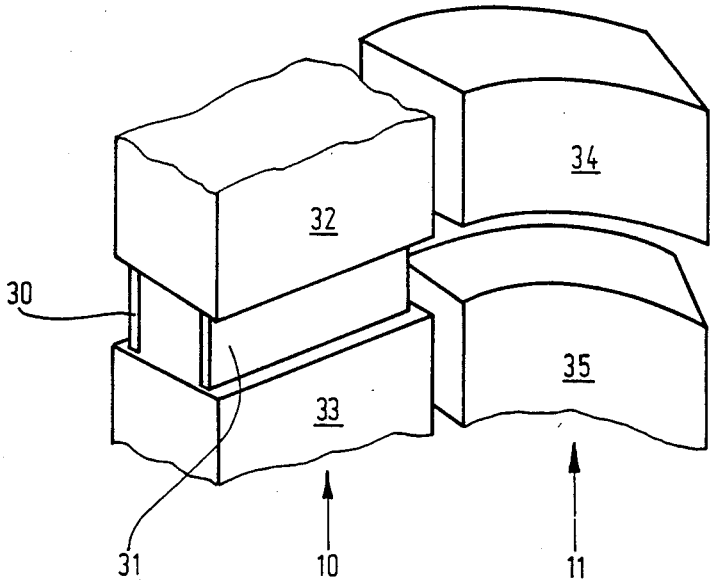
Figure 3:
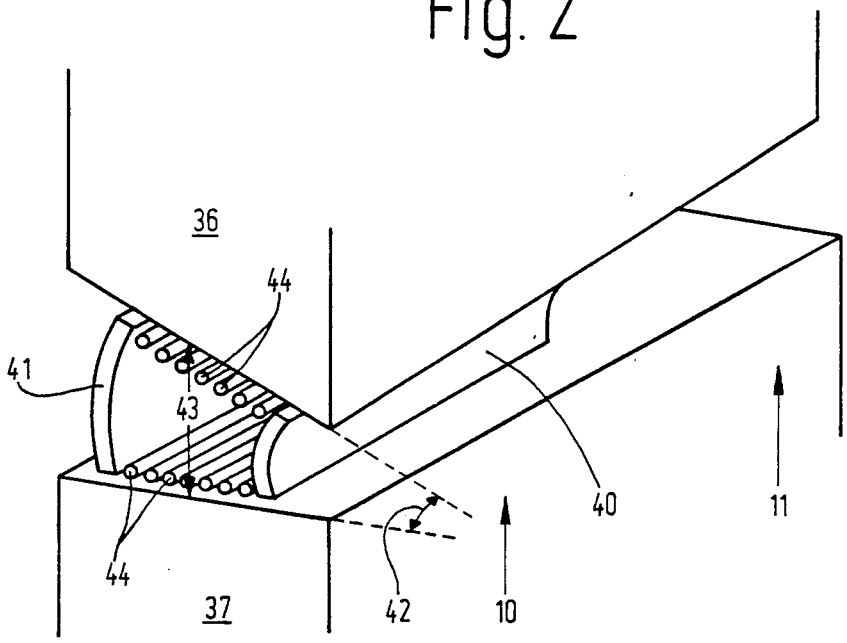
Figure 4:
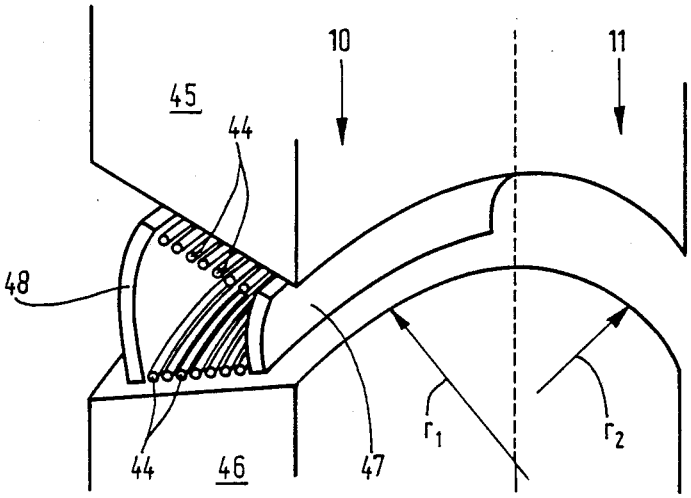
Figure 5:
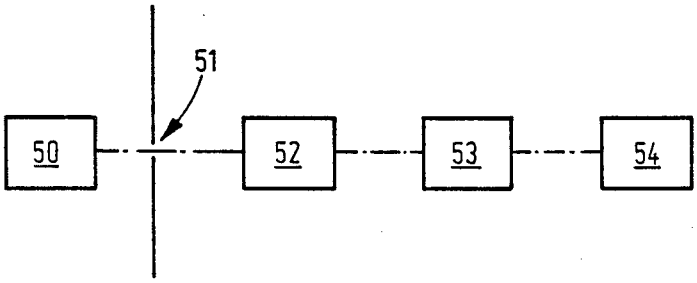

An illustrative embodiment of the invention is represented in the drawings and is to be explained hereinbelow. In the drawings:

FIG. 1 shows a diagrammatic arrangement of a Wien filter-sector magnet combination, FIG. 2 shows a diagrammatic combination of a conventional Wien filter and of a toroidal sector magnet, the respective pole piece pairs of the sector magnet and of the Wien filter being separate, FIG. 3 shows a diagrammatic mass spectrometer arrangement with continuous pole pieces which are disposed in a wedge shape in relation to one another, FIG. 4 shows a diagrammatic representation of the mass spectrometer according to the invention with in each instance continuous toroidal magnet pole pieces, the radius of the torus in the sector magnet region being different from that in the Wien filter region, and FIG. 5 shows a diagrammatic representation of an MS/MS arrangement.

The double focusing mass spectrometer according to the invention consists of a Wien filter 10 and a sector magnet 11 connected downstream, upstream of which, according to FIG. 1, a quadrupole arrangement 12 having a strength of, for example, $k_o = -2.683$ is connected and downstream of which two quadrupole arrangements 13 and 14, for example, of a strength of $k_1 = 2.475$ and $k_2 = -2.405$ respectively are connected. The arriving ion stream 15 passes through the mass spectrometer 10, 11; in this case, it is dispersed in a known manner and is selectively focused in the focal or image plane 16.

In particular, a separating tube 17 is also provided, which extends at least through the Wien filter 10 and, in the present case, also through the sector magnet 11.

All lengths or spacing measurements indicated hereinbelow are relative indications, which are measured with respect to the orbital radius $\rho_{B0}$ of a reference ion in the sector magnet 11, for example, of 270 mm at 1.2 Tesla.

Thus, in a specific illustrative embodiment, the ion stream 15 passes through a field-free distance 18 in front of the quadrupole 12 of 1.5, subsequently the quadrupole 12 having a length 19 of 1.667, a further field-free distance, which is determined by the spacing 20 between the upstream quadrupole 12 and the Wien filter 10, of 0.333, the Wien filter 10 having a length 21 of 0.544, the sector magnet 11, where it experiences a deflection angle 22 of $\epsilon = 26.65°$ in the magnetic field operative there, and a further field-free distance, the spacing 23 from the sector magnet 11 or the exit side thereof and the first downstream quadrupole 13 of 0.222, the first quadrupole 13 having a length 24 of 0.167, a further field-free distance, namely the spacing 25 to the second quadrupole 14 of 0.055, the second quadrupole 14 having a length of 0.167, as well as a final field-free distance 27 from the second quadrupole 14 to the image plane 16 of 0.370.

The inclination 28 of the exit magnetic field boundary is −25.83, and the degree of curvature 29 of the exit magnetic field boundary is 0.555.

The example which has been implemented is also listed in the table given hereinbelow (see column G).

| | 21 | 22 | 28 | $k_o$ | 19 | 18 | 20 | 27 | 29 |
|---|---|---|---|---|---|---|---|---|---|
| A | 0.524 | 30° | 0 | 0 | 0 | 1.732 | 0 | 1.732 | 0 |
| B | 0.524 | 30° | 0 | −1.63 | 0.2 | 4.677 | 0.3 | 1.732 | 0 |
| C | 0.566 | 30° | −20° | −2.03 | 0.2 | 2.5 | 0.3 | 1.273 | 0 |
| D | 0.583 | 30° | −30° | −2.20 | 0.2 | 2.0 | 0.3 | 1.051 | 0 |
| E | 0.499 | 25° | −30° | −2.22 | 0.2 | 2.0 | 0.3 | 1.312 | 0 |
| F | 0.542 | 26.65° | −25.83° | −2.643 | 0.167 | 1.5 | 0.333 | 1.453 | −1.8 |
| G | 0.544 | 26.65° | −25.83° | −2.683 | 1.667 | 1.5 | 0.333 | 0.370 | 0.555 |

Apart from the quantities set forth in each instance in Table 1, further illustrative embodiments A to F are also distinguished from the illustrative embodiment G in that in the case A neither a quadrupole 12 nor quadrupoles 13, 14 are connected upstream or downstream or, in the cases B to F, the operation was carried out only with an upstream quadrupole 12, but without downstream quadrupoles 13, 14.

Apart from the combination, which has already been discussed, of the Wien filter 10 with the sector magnet 11 has double focusing mass spectrometer, the feature of the common magnet is represented in detail in FIGS. 2 to 4.

According to FIG. 2, capacitor plates 30, 31 are disposed in the Wien filter 10 between two magnet pole pieces 32, 33 in a conventional mode of construction for a Wien filter, which is known in principle according to the prior art. The magnet pole pieces 34, 35 of the sector magnet 11 are indeed separate from those of the Wien filter 10, but both pole piece pairs exhibit a common magnetic coil and a common magnet yoke. The magnet pole pieces 32, 34 are in each instance parallel to the magnet pole pieces 33, 35.

As an alternative to this, FIG. 3 shows a wedge-shaped magnet pole piece arrangement, which consists of magnet pole pieces 36 and 37 which extend linearly continuously. In other words, the magnetic field generated by the said pole pieces 36, 37 is used jointly in the Wien filter and sector magnet 11; in this case, the Wien filter electrodes 40, 41 are designed so as to be cylindrical. The wedge angle formed by the magnet pole pieces 36, 37 is designated by 42, and their average spacing by 43. Furthermore, additional wire-type electrodes 44 are provided, which extend in respective longitudinal guiding below and above the magnet pole pieces 36 and 37 respectively.

In contrast, the Wien filter-sector magnet arrangement represented in FIG. 4 does indeed likewise possess continuous magnet pole pieces 45, 46, but these are designed so as to be toroidal, in such a manner that the two torus radii $r_1$ in the region of the Wien filter 10 and $r_2$ in the region of the sector magnet 11 are of differing size. In appropriate matching to the magnet pole pieces, the electrodes 47 and 48 are likewise toroidal and in other respects designed so as to be cylindrical, like the concentrically extending additional electrodes 44.

At least the additional electrodes 44 can be disposed on or in a separating tube 17 (FIG. 1); corresponding considerations apply to the additional electrodes 44 according to FIG. 3.

FIG. 5 shows an MS/MS arrangement in a diagrammatic representation. From an ion source 50, so-called parent ions pass through a gap 51 to a Ist analyzer 52, which analyzes the parent ion stream. After emerging from the Ist analyzer 52, the ions pass into a so-called CID device 53, a collision cell, for example, designed as a high-energy collision chamber; in this case, a so-called daughter ion stream is generated by fragmentation of the parent ions, which daughter ion stream is analyzed by the IInd analyzer 54. At least the IInd analyzer 54 is constructed in the form of a mass spectrometer represented in FIGS. 1 to 4.

We claim:

1. A double focusing mass spectrometer having a combination of an electrical and a magnetic field for directional and velocity forming comprising a combination of a Wien filter and of a sector magnet, characterized in that the Wien filter (10) and the sector magnet (11) possess a common magnet (32 to 37; 45, 46), the pole pieces of which are constructed to be continuous.

2. The mass spectrometer as claimed in claim 1, wherein the magnet pole pieces (36, 37 and/or 32, 33; 34, 35; 36, 37; 45, 46) are disposed flat and parallel to one another.

3. The mass spectrometer as claimed in claim 1, wherein the magnet pole pieces (36, 37) are flat and inclined to one another (wedge arrangement).

4. The mass spectrometer as claimed in claim 1, wherein the magnet pole pieces (45, 46) are designed, in the region of the Wien filter (10) and of the sector magnet (11), to be of differing configuration, conically or toroidally, i.e., with different radii ($r_1$, $r_2$).

5. The mass spectrometer as claimed in claim 4, wherein the magnet pole pieces (36, 37; 45, 46), in the region of the Wien filter (10), enclose cylindrical (40, 41) and/or toroidal (47, 48) electrodes.

6. The mass spectrometer as claimed in claim 1, wherein the magnet pole pieces (32, 33; 36, 37), in the region of the Wien filter (10), enclose electrode (capacitor) plates (30, 31; 40, 41) which are parallel to one another.

7. The mass spectrometer as claimed in claim 6, wherein the electrodes (30, 31; 40, 41; 47, 48) are designed as parallel wires, parallel sheet metal strips and/or parallel conductive paths, preferably on printed circuits.

8. The mass spectrometer as claimed in claim 6, wherein below and above the magnet pole pieces (32, 33; 36, 37; 45, 46), and extending parallel to these, parallel wires, parallel sheet metal strips and/or printed conductive paths, preferably on printed circuits, are disposed as additional electrodes (44), possible also in a toroidal arrangement.

9. The mass spectrometer as claimed in claim 6, wherein a separating tube (17), which is preferably rectangular in cross section, is guided through the entire Wien filter (10), to which separating tube the electrodes are secured.

10. The mass spectrometer as claimed in claim 1, wherein a quadrupole optical system, which consists in each instance of one or more electrostatic or magnetic quadrupole lenses, is connected upstream (12) and/or downstream (13, 14) of the Wien filter-sector magnet combination (10, 11).

11. The mass spectrometer as claimed in claim 1, wherein a hexapole or octopole arrangement, which consists in each instance of one or more electrostatic and/or magnetic hexapoles or octopoles, is connected upstream and/or downstream of the Wien filter-sector magnet combination (10, 11).

12. The mass spectrometer as claimed in claim 1, wherein the hexapoles and/or octopoles are superimposed on one or more quadrupoles (12, 13, 14).

13. An MS/MS arrangement, consisting of a first mass spectrometer (Ist analyzer), a CID device (collision cell) and a second mass spectrometer (IInd analyzer), wherein at least one of the analyzers (52, 54) is a double focusing mass spectrometer comprising a combination of a Wien filter and of a sector magnet, whereby the Wien filter (10) and the sector magnet (11) possess a common magnet (32 to 37; 45, 46) which pole pieces are constructed to be continuous.

14. The MS/MS arrangement as claimed in claim 13, wherein the IInd analyzer (54) is the double focusing mass spectrometer with the Wien filter (10).

* * * * *